US007393272B2

(12) United States Patent
Sundet

(10) Patent No.: US 7,393,272 B2
(45) Date of Patent: Jul. 1, 2008

(54) AIR FILTER ASSEMBLY

(75) Inventor: Douglas C. Sundet, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 738 days.

(21) Appl. No.: 11/025,569

(22) Filed: Dec. 29, 2004

(65) Prior Publication Data

US 2006/0188366 A1 Aug. 24, 2006

(51) Int. Cl.
*B63H 5/16* (2006.01)

(52) U.S. Cl. ..... 454/275; 55/471; 416/247 R

(58) Field of Classification Search ..... 454/275, 454/339; 96/134; 55/471, 496, 497
See application file for complete search history.

(56) References Cited

U.S. PATENT DOCUMENTS

| | | | | | |
|---|---|---|---|---|---|
| 363,538 | A | | 5/1887 | Penny | |
| 2,812,900 | A | * | 11/1957 | Matthews | 416/247 R |
| 2,923,463 | A | * | 2/1960 | Shunkwiler | 416/247 R |
| 3,103,218 | A | | 9/1963 | Ajemian | |
| 3,262,638 | A | * | 7/1966 | Militello | 416/247 R |
| 3,523,409 | A | * | 8/1970 | Paterson | 55/471 |
| 3,740,934 | A | * | 6/1973 | Shuler | 55/490 |
| 3,999,969 | A | * | 12/1976 | Shuler | 55/418 |
| 4,477,272 | A | | 10/1984 | Hollis et al. | |
| 4,781,526 | A | * | 11/1988 | Mead | 415/121.2 |
| 4,898,516 | A | * | 2/1990 | Hendricks | 416/247 R |
| 5,094,676 | A | * | 3/1992 | Karbacher | 96/142 |
| 5,156,662 | A | * | 10/1992 | Downing et al. | 55/493 |
| 5,234,462 | A | * | 8/1993 | Pavletic | 606/215 |
| 5,409,189 | A | | 4/1995 | Luhmann | |
| D359,800 | S | * | 6/1995 | Cich et al. | D23/365 |
| 5,529,593 | A | * | 6/1996 | Simmons | 55/354 |
| D372,079 | S | * | 7/1996 | Fago et al. | D23/365 |
| D377,994 | S | * | 2/1997 | Morrill | D26/119 |
| 5,681,364 | A | * | 10/1997 | Fortune | 55/400 |
| 5,809,800 | A | * | 9/1998 | Deal | 62/507 |
| 5,868,189 | A | * | 2/1999 | Jarvis | 150/165 |
| D408,513 | S | | 4/1999 | Reede | |
| 5,904,744 | A | * | 5/1999 | Kagan | 55/385.1 |

(Continued)

FOREIGN PATENT DOCUMENTS

| | | |
|---|---|---|
| JP | 2-290212 | 11/1990 |

(Continued)

*Primary Examiner*—Derek S. Boles
(74) *Attorney, Agent, or Firm*—David B. Patchett

(57) ABSTRACT

A kit for forming an air filtering assembly from a portable box fan assembly having a parallelepiped housing with square open sides through which an electric motor driven fan in the housing propels air, and a filter assembly including a parallelepiped frame with opposite sides with through openings generally corresponding in size to the open sides of the housing of the box fan assembly and a sheet of air filtering material within the filter assembly frame between its sides. The kit includes (1) a plurality of clips or hooks; (2) a lengths of adhesive for adhering the clips or hooks to outer surfaces of side portions of the housing for the box fan assembly; and (3) a resiliently elastic cord adapted to extend through passageways in the clips or hooks and between the clips or hooks around the side of the filter assembly opposite the box fan assembly to retain the filter assembly along one of the sides of the housing of the box fan assembly.

15 Claims, 3 Drawing Sheets

U.S. PATENT DOCUMENTS

| | | | | |
|---|---|---|---|---|
| 6,045,329 | A * | 4/2000 | Sobala | 416/146 R |
| 6,264,727 | B1 | 7/2001 | Elmore | |
| D449,098 | S * | 10/2001 | Reede | D23/365 |
| D449,879 | S * | 10/2001 | Sobala | D23/365 |
| 6,398,835 | B1 * | 6/2002 | Rehil | 55/471 |
| 6,403,206 | B1 | 6/2002 | Bries et al. | |
| 6,527,838 | B2 * | 3/2003 | Volo et al. | 96/134 |
| 6,685,760 | B2 * | 2/2004 | Huehn et al. | 55/471 |
| 6,780,216 | B2 * | 8/2004 | Kiilunen | 55/385.6 |
| 6,874,209 | B2 * | 4/2005 | Volo et al. | 24/522 |
| 7,323,028 | B2 * | 1/2008 | Simmons | 55/495 |
| 2004/0172928 | A1 | 9/2004 | Kubokawa | |

FOREIGN PATENT DOCUMENTS

| | | |
|---|---|---|
| JP | 9-225233 | 9/1997 |
| JP | 2002-58933 | 2/2002 |
| JP | 2002-130760 | 5/2002 |
| WO | WO 95/06691 | 3/1995 |

* cited by examiner

AIR FILTER ASSEMBLY

FIELD OF THE INVENTION

The present invention relates to air filtering assemblies that can be used to remove particles from air in an enclosed space.

BACKGROUND OF THE INVENTION

Air filtering assemblies are known that can be used to remove particles from air in an enclosed space. Typically such air filtering assemblies include an air filter which can include a sheet of air filtering material or can work by electrostatic attraction, and also include a fan assembly that moves the air through the air filter. Such air filtering assemblies can continuously circulate a small portion of the air in the enclosed space through the filter so that over time the air filtering assembly improves the cleanliness of the air in the enclosed space. U.S. Pat. Nos. 4,477,272, 4,781,526, 6,045,329, and 6,264,727 describe such air filtering assemblies.

U.S. Pat. No. 4,781,526 describes such an air filtering assembly that is a combination of (1) a portable box fan assembly having a parallelepiped housing with square open sides on which protective grills are mounted, an electric motor having a fixed portion mounted on and within the housing and a rotor assembly on which is mounted a fan also within the housing that, when the motor is activated via means for connecting the motor to a source of electric power included in the box fan assembly, rotates about an axis normal to and generally centered on the side surfaces to move air through the protective grills, and (2) a filter assembly including a parallelepiped frame having opposite rectangular sides with through openings generally corresponding in size to the open sides of the housing of the box fan assembly and including a peripheral wall between the peripheries of the sides, and a sheet of air filtering material within the filter assembly frame between its sides. The air filtering assembly described in both U.S. Pat. No. 4,781,526 has special structure 16 included with the housing for positioning and retaining the filter assembly with one of its sides along and aligned with one of the side surfaces of the box fan. Thus, it would be difficult for a person who had filter assembly of the type described above and a box fan assembly of the type described above without that special structure to position and retain the filter assembly with one of its sides along and aligned with one of the side surfaces of the box fan assembly to make an air filtering assembly.

DISCLOSURE OF THE INVENTION

The present invention provides a kit by which a person who has a filter assembly of the type described above and a box fan assembly of the type described above without special structure like that described in U.S. Pat. No. 4,781,526 can easily and effectively form an air filtering assembly with one of the sides of the filter assembly along and aligned with one of the open sides of the housing for the box fan assembly, and which also allows that person to subsequently separate the filter assembly from the box fan assembly without any change to either one.

The kit according to the present invention for forming the air filtering assembly joins (1) a portable box fan assembly having a parallelepiped housing with square open sides on which protective grills are mounted, an electric motor having a fixed portion mounted on and within the housing and a rotor assembly on which is mounted a fan blade also within the housing that, when the motor is activated via means for connecting the motor to a source of electric power included in the box fan, rotates about an axis normal to and generally centered on the side surfaces to move air through the protective grills, the housing including a peripheral wall between the peripheries of the open sides including opposite side portions; and (2) a filter assembly including a parallelepiped frame having opposite rectangular sides with through openings generally corresponding in size to the sides of the housing of the box fan assembly and including a peripheral wall between the peripheries of the sides, and a sheet of air filtering material within the filter assembly frame between its sides.

The kit according to the present invention includes (1) a plurality of attachment members (e.g., clips or hooks) each having a rear portion, a front portion extending along a front surface of the rear portion, and an end portion joining adjacent first ends of the rear and front portions and defining a passageway transverse of the front, rear, and end portions; (2) a plurality of lengths of adhesive adapted for adhering rear surfaces of the attachment members to outer surfaces of the side portions of the peripheral wall; and (3) at least one resiliently elastic cord adapted to extending through the passageways in the attachment members and between the attachment members around the side of the filter assembly opposite the box fan assembly to retain the filter assembly along one of the sides of the housing of the box fan assembly.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
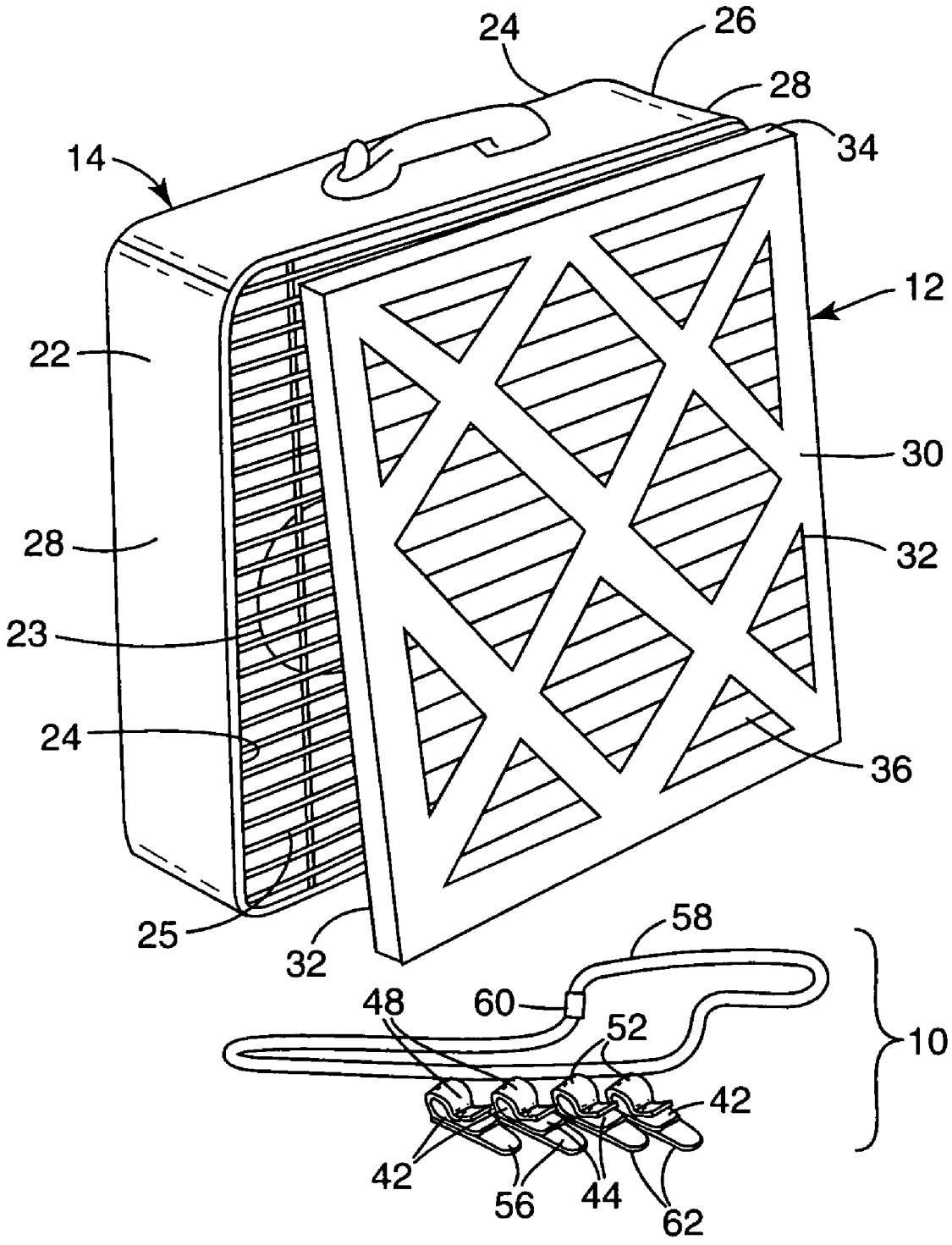
FIG. 1 is a perspective view of the parts of a kit according to the present invention that can be used to attach an air filter assembly to a box fan assembly also illustrated in FIG. 1 to form an air filtering assembly according to the present invention.
Figure 2:
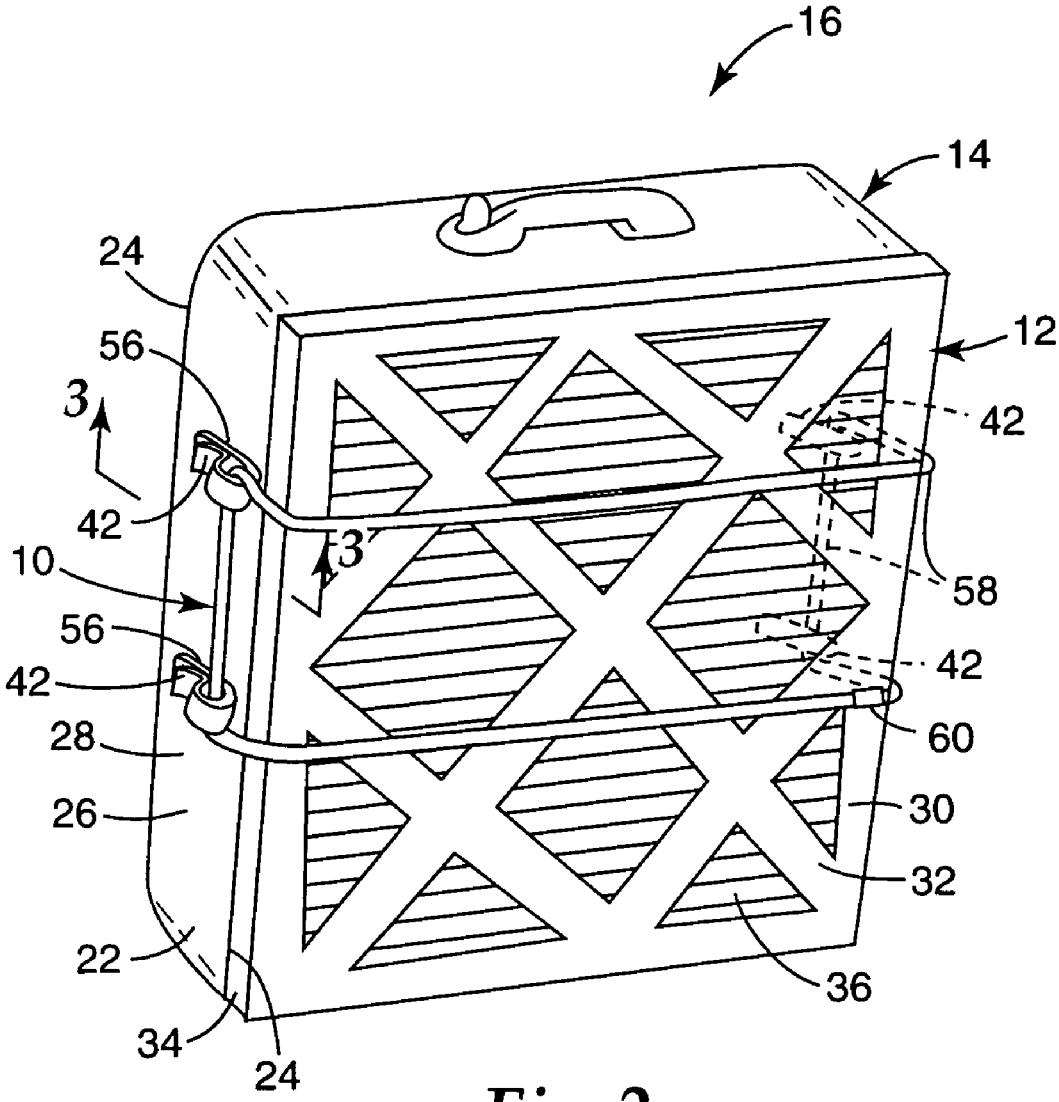
FIG. 2 illustrates the kit shown in FIG. 1 in use to form the air filtering assembly according to the present invention.

Referring now to the drawing there is illustrated in FIG. 1 a kit 10 according to the present invention that can be used to attach an air filter assembly 12 to a box fan assembly 14 to form an air filtering assembly 16 according to the present invention that is illustrated in FIG. 2.

The box fan assembly 14 to which the filter assembly 12 is attached is of a well known and commercially available type having a parallelepiped housing 22 with square open sides 24 on which protective grills 25 are mounted, an electric motor (not shown) having a fixed portion mounted on and within the housing 22 and a rotor assembly on which is mounted a fan blade 23 also within the housing 22 that, when the motor is activated via means for connecting the motor to a source of electric power included in the box fan assembly 14, rotates about an axis normal to and generally centered on the sides 24 to move air through the protective grills 25. The housing 22 includes a peripheral wall 26 between the peripheries of the open sides 24 including opposite side portions having outer surfaces 28.

The box fan assembly 14 can be one of any of a number of readily available fan assemblies such as or similar to the box fan commercially designated K-Mart Model K-233, manufactured by Lakewood Engineering and manufacturing company, Chicago, Ill. Such box fans typically have open sides 24 of their housings 22 that are about 22 inches (55.8 cm) square;

The filter assembly 12 is also of a well known and commercially available type including a parallelepiped frame 30 (e.g., of cardboard or polymeric material) having opposite sides 32, with through openings and generally rectangular peripheries, and having a peripheral wall 34 between the peripheries of the sides 32; and a sheet 36 of air filtering material within the filter assembly frame 30 between its sides 32. The sides 32 of the filter assembly 12 generally correspond in shape and size to the sides 24 of the housing 22 of the box fan assembly 14. The filter assembly 12 can be one of any of a number of readily commercially available filter assemblies such as the filter assembly commercially designated "3M Filtrete (trademark) 1000 Micro Allergen filter", that is available from 3M Company, St. Paul, Minn., or the filter assembly described in U.S. Publication 20040172928 published Sep. 9, 2004 of U.S. patent application Ser. No. 10/379,069 filed Mar. 4, 2003 (incorporated herein by reference), either of which can have side surface dimensions of about 20 by 20 inches and are about 1 inch thick between those side surfaces (49.8 by 29.8 cm by 2 cm thick).

Figure 3:
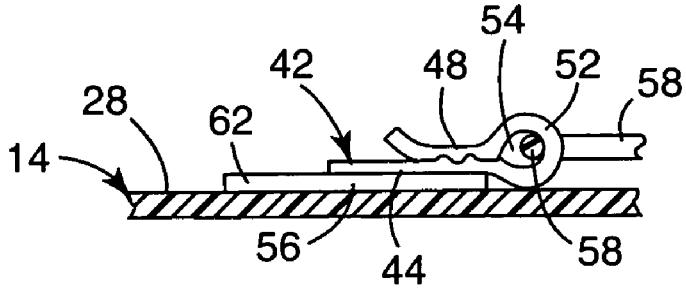
FIG. 3 is an enlarged fragmentary view taken approximately along line 3-3 of FIG. 2 that provides a side view of one of a plurality of clips included in the kit of FIG. 1.

The kit 10 includes a plurality of (e.g., 4 as illustrated) attachment members or clips 42 of a resiliently flexible material. Each of the clips 42 (see FIGS. 1 and 3) has a rear portion 44 having front and rear surfaces, a front portion 48 laying along the front surface of the rear portion 44; and an arcuate end portion 52 joining adjacent ends of its rear and front portions 44 and 48 and defining a generally cylindrical passageway 54 transverse of its front, rear, and end portions 48, 44, and 52.

The kit 10 also includes a plurality of (e.g. 4) lengths 56 of stretch release adhesive that can releasably adhere the rear surfaces of the rear portions 44 of the clips 12 to the outer surfaces 28 of the opposite side portions of the housing 22 for the box fan assembly 14; and at least one elastic cord 58, which elastic cord 58 as illustrated has its opposite ends joined together by a metal ferrule 60 to form the cord 58 into a loop. After the clips 42 are attached to the outer surfaces 28 of the opposite side portions of the housing 22 one of the sides 32 of the air filter assembly 12 can be positioned along one of the sides 24 of the housing 22, and the cord 58 can be positioned to extend through the passageways in the clips 42 and between the clips 42 around the air filter assembly 12 to hold it against the box fan assembly 14 to form the air filtering assembly 16 shown in FIG. 2.

As illustrated in FIG. 1 the kit 10 can include four clips 42 and one elastic cord 58 formed in a loop (which cord 58 can, for example, have a length of about 56 inches or 142.2 cm), two of which clips 42 can be attached to the outer surface 28 of each opposite side portion of the housing 22 with the clips 42 spaced (e.g., at about 12 inches or 30.5 cm) one above the other and about equally spaced from the top and bottom surfaces of the housing 22 by adhering the rear surfaces of the rear portions 44 of the clips 42 to that surface 28 using the lengths 56 of stretch release adhesive, after which the cord 58 is inserted into and stretched between the clips 42. When desired, the kit 10 can be cleanly removed from the air filter assembly 12 and the box fan assembly 14 by first removing the cord 58 from the clips 42 and then stretching the lengths 56 of stretch release adhesive by pulling on a tab 62 at the end of each length 56, which stretching will release the adhesion of the length 56 of adhesive to the clip 42 and to the surfaces 28 of the opposite side portions of the housing 22.

The elastic cord 58 should be strong, capable of being stretched to about twice its un-stretched length, and should require a significant force to stretch it. The cord 58 can have a fabric covering that is neutral in color to make it inconspicuous, or can be colored in one of or in a series of different colors along successive portions of its length, can have a diameter of about 0.13 inch or 0.33 cm when not stretched, and can require about 0.14 pounds per inch to stretch it to twice its length. A suitable elastic cord 58 having these properties is commercially available from King Wo Industries (International) Ltd., Kowloon, Hong Kong.

The clips 42 can be molded of a resiliently flexible polymeric material (e.g., polypropylene), with the passageway 54 through each clip 42 having a diameter (e.g., about 0.2 inch or 0.51 cm) which allow parts of the cord 58 to be positioned in the passageway 44 without pushing its front portion 48 away from its rear portion 44. The front portion 48 of each clip 42 presses firmly against (i.e., is biased against) its rear portion 44 and those portions 48 and 44 have opposed transverse ribs that nest between each other to firmly hold portions of the cord 58 between them before and while the cord 58 is being stretched or un-stretched. A part of the front portion 48 adjacent its distal end is curved away from the rear portion 44 to facilitate inserting the cord 58 between the portions 48 and 44. As an example, each clip 42 can have a width of about 0.625 inch or 1.6 cm, a rear portion 44 length of about 1.125 inch or 2.86 cm, and a thickness of the arcuate end portion 52 of about 0.075 inch. or 0.19 cm.

The lengths 56 of stretch release adhesive can be made as described in U.S. Pat. No. 6,403,206 (Bries et al), or the corresponding International Published Application WO 95/06691. Generally, such lengths of stretch release adhesive each comprise a central layer of polymeric foam (e.g., polyolefin foam), two layers of stretchable polymeric film (e.g., polyethylene or polypropylene film, with linear low density and ultra linear low density polyethylene film being preferred) bonded along opposite major surfaces of the layer of foam, and outer layers of stretch release adhesive that are adhered along the surfaces of the layers of film opposite the central layer of polymeric film except at one end that provides the tab 62. When that length 56 of stretch release adhesive is sequentially stretched by pulling on the tab 62, the layers of adhesive will release respectively from the surfaces to which they are adhered. Preferably the lengths 56 of stretch release adhesive are about 0.63 inch or 1.6 centimeters wide and about 1.88 inch or 4.8 cm long including the tab portion 62 which is about 0.75 inch or 1.9 cm long; such lengths 56 of stretch release adhesive being commercially available from 3M Company, St. Paul, Minn. under the trademarks "Command Adhesive", "Command Strips" and "Command Water Resistant Strips".

Alternatively, the lengths 56 of stretch release adhesive could consist of two layers of stretch release adhesive that define the major adhesive surfaces adhered along opposite major surfaces of a single layer of stretchable polymeric film, or could be the attachment strip described in U.S. Pat. No. 5,409,189 (Luhmann), which attachment strip consists of a single layer of pressure sensitive adhesive that would define the two major adhesive surfaces, and has a polymeric film covering over its projecting tab end portion to provide non-sticky surfaces for its tab portion by which the layer of pressure sensitive adhesive can be stretched to cause it to release from surfaces between which it has been adhered.

Figure 4:
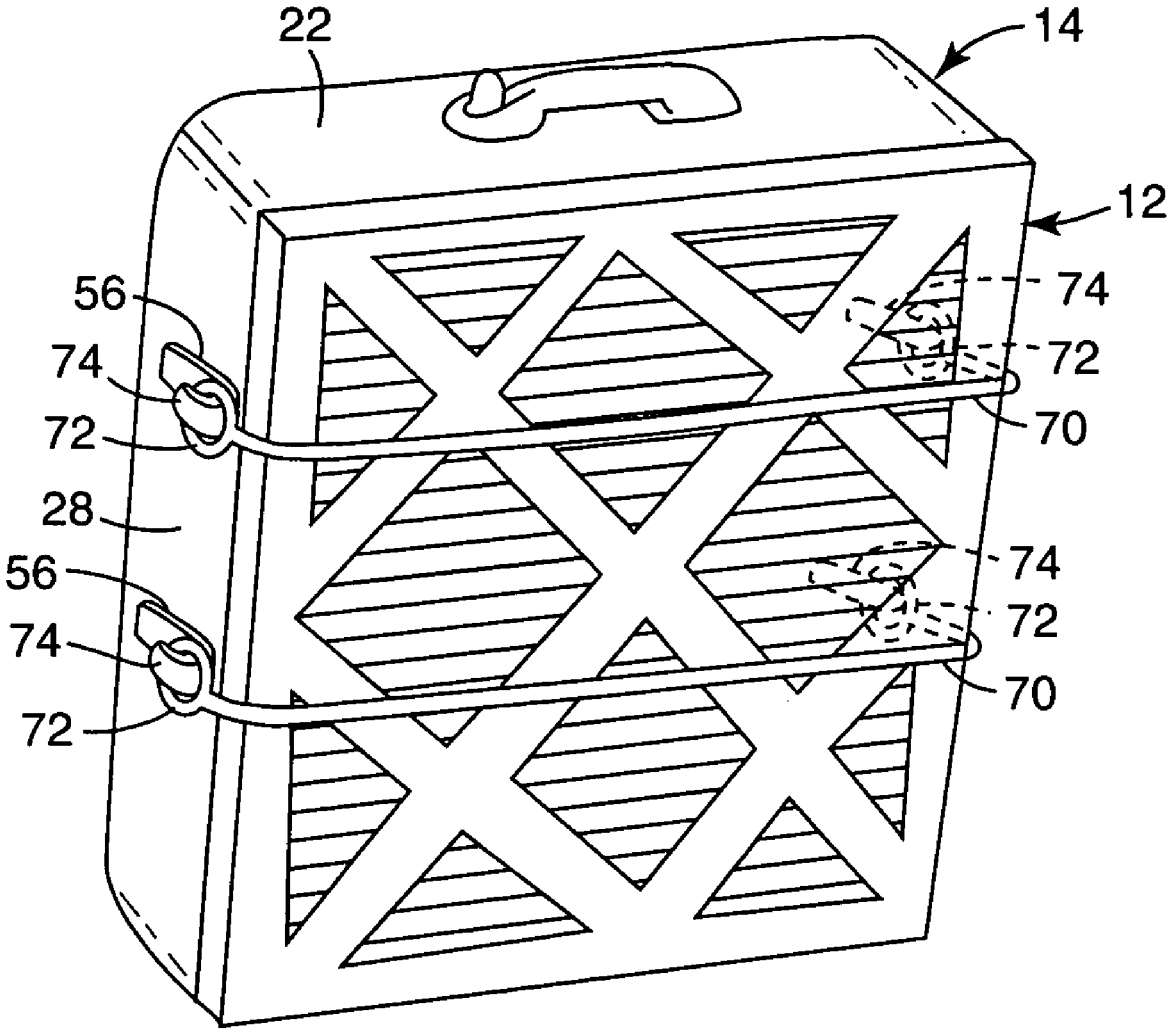
FIG. 4 is a perspective view of alternate embodiments of a cord and attachment members that can be used in the kit of FIG. 1 that are being used to attach an air filter assembly to a box fan assembly also illustrated in FIG. 4 to form an air filtering assembly according to the present invention.

The present invention has now been described with reference to one embodiment. It will be apparent to those skilled in the art that many changes can be made in the embodiment described without departing from the scope of the present invention. For example, any number of clips 42 and elastic cords 58 can be used to hold the filter assembly 12 against the box fan assembly 14, with four to twelve clips 42 and one to three cords 58 being the most practical. Any one elastic cord may not have its ends joined, but can instead have knots formed at its ends to prevent those ends from slipping through the passageways 54 in the clips 42; or can instead have loops formed at its ends to allow those loops to be engaged with the passageways 54 in the clips 42. Two such an elastic cords 70 with loops 72 at their ends are shown in FIG. 4 attaching the air filter assembly 12 described above to the box fan assembly 14 described above. As illustrated in FIG. 4, attachment members in the form of hooks 74 can be substituted for the clips 42 described above, such as the white hooks commercially designated "Command" (trademark) Small Hooks, No. 17002 that are available from 3M Company, St. Paul, Minn., or the transparent hooks commercially designated "Command" (trademark) Mini Hooks, No. 17006 that are also available from 3M Company. Like the clips 42, those hooks 74 also each have a rear portion having a rear surface, a front surface opposite its rear surface, and first and second spaced ends; a front portion extending along and spaced from the front surface of the rear portion and having first and second spaced ends, and an end portion joining the first ends of the rear and front portions and defining a passageway transverse of the front, rear, and end portions. Also, either the clips 42 or hooks 74 can be adhered to the surface 28 either with the lengths 62 of stretch release adhesive, or with lengths of permanent adhesive if there is no desire to easily remove the clips 42 or hooks 74 from the housing 22 of the box fan 14. Thus, the scope of the present invention should not be limited to the structures and methods described in this application, but only by the structures and methods described by the language of the claims and the equivalents thereof.

What is claimed is:

1. An air filtering assembly including:

a box fan assembly, said box fan assembly including:

a parallelepiped housing with square open sides, an electric motor having a fixed portion mounted on and within the housing and a rotor assembly, a fan blade also within the housing and mounted on said rotor assembly means for connecting the motor to a source of electric power so that the rotor assembly and fan rotate about an axis normal to and generally centered on said open side surfaces of the housing to move air through the open sides, said housing including a peripheral wall between the peripheries of the open sides including opposite side portions having outer surfaces;

a filter assembly, said filter assembly including a parallelepiped frame having opposite sides, said sides having through openings and generally rectangular peripheries, and having a peripheral wall between the peripheries of said sides, and a sheet of filter material within said filter assembly frame between said sides, one of said sides of said filter assembly corresponding in shape to and being along one of the sides of said housing of said box fan assembly;

a plurality of attachment members, each of said attachment members having a rear portion having a rear surface, a front surface opposite said rear surface, and first and second spaced ends; a front portion extending along the front surface of said rear portion and having first and second spaced ends, and an end portion joining the first ends of said rear and front portions and defining a passageway transverse of said front, rear, and end portions;

a plurality of lengths of adhesive adhering the rear surfaces of said attachment members to the outer surfaces of the side portions of said peripheral wall; and at least one resiliently elastic cord extending through the passageways in the attachment members and between the attachment members around the side of the filter assembly opposite said box fan assembly to retain said filter assembly along one of the sides of said housing of said box fan assembly.

2. An air filtering assembly according to claim 1 wherein said attachment members are clips of resiliently flexible material, said front portion of each of the clips lays along and is biased against the front surface of the rear portion of the clip.

3. An air filtering assembly according to claim 1 wherein said elastic cord has opposite ends joined to each other to form the cord into a loop.

4. An air filtering assembly according to claim 1 wherein said elastic cord has opposite ends and a loop of the cord formed at each of said opposite ends, said loops extending through the passageways in the attachment members.

5. An air filtering assembly according to claim 1 wherein said display assembly includes at least 4 attachment members and at least 1 elastic cord with two of the attachment members being adhered to each of the side portions of said peripheral wall.

6. An air filtering assembly according to claim 1 wherein said attachment members are hooks with said front portions spaced from said rear portions.

7. An air filtering assembly according to claim 1 wherein said lengths of adhesive are lengths of stretch release adhesive.

8. A kit for forming an air filtering assembly from a box fan assembly and a filter assembly, the box fan assembly being of the type having a parallelepiped housing with square open sides on which protective grills are mounted, an electric motor having a fixed portion mounted on and within the housing and a rotor assembly on which is mounted a fan blade also within the housing that, when the motor is activated via means for connecting the motor to a source of electric power included in the box fan, rotates about an axis normal to and generally centered on the side surfaces to move air through the protective grills, said housing including a peripheral wall between the peripheries of the open sides including opposite side portions; and the filter assembly being of the type including a parallelepiped frame having opposite sides, said sides having through openings and generally rectangular peripheries, and having a peripheral wall between the peripheries of said sides, and a sheet of air filtering material within said filter assembly frame between said sides, said sides of said filter assembly generally corresponding in shape and size to the sides of said housing of said box fan assembly;

said kit including a plurality of attachment members each having a rear portion having a rear surface, a front surface opposite said rear surface, and first and second spaced ends; a front portion extending along the front surface of said rear portion and having first and second spaced ends, and an end portion joining the first ends of said rear and front portions and defining a passageway transverse of said front, rear, and end portions;

a plurality of lengths of adhesive adapted for adhering the rear surfaces of said attachment members to the outer surfaces of the side portions of said peripheral wall; and at least one resiliently elastic cord adapted, when said attachment members are adhered to the side portions of the peripheral wall, to extending through the passageways in the attachment members and between the attachment members around the side of the filter assembly opposite said box fan assembly to retain said filter assembly along one of the sides of said housing of said box fan assembly.

9. A kit for forming an air filtering assembly according to claim 8 wherein said attachment members are clips of resiliently flexible material, said front portion of each of the clips lays along and is biased against the front surface of the rear portion of the clip.

10. A kit for forming an air filtering assembly according to claim 8 wherein said elastic cord has opposite ends joined to each other to form the cord into a loop.

11. An air filtering assembly according to claim 8 wherein said elastic cord has opposite ends and a loop of the cord formed at each of said opposite ends, said loops being adapted to extend through the passageways in the attachment members.

12. A kit for forming an air filtering assembly according to claim 8 including at least 4 attachment members.

13. An air filtering assembly according to claim 8 wherein said attachment members are hooks with said front portions spaced from said rear portions.

14. An air filtering assembly according to claim 8 wherein said lengths of adhesive are lengths of stretch release adhesive.

15. A method for forming an air filtering assembly including the steps of:

providing a box fan assembly of the type having a parallelepiped housing with square open sides on which protective grills are mounted, an electric motor having a fixed portion mounted on and within the housing and a rotor assembly on which is mounted a fan blade also within the housing that, when the motor is activated via means for connecting the motor to a source of electric power included in the box fan, rotates about an axis normal to and generally centered on the side surfaces to move air through the protective grills, said housing including a peripheral wall between the peripheries of the open sides including opposite side portions;

providing a filter assembly of the type including a parallelepiped frame having opposite sides, said sides having through openings and generally rectangular peripheries, and having a peripheral wall between the peripheries of said sides, and a sheet of filter material within said filter assembly frame between said sides, said sides of said filter assembly corresponding in shape to the open sides of the housing of said box fan assembly;

providing a plurality of attachment members each having a rear portion having a rear surface, a front surface opposite said rear surface, and first and second spaced ends; a front portion extending along the front surface of said rear portion and having first and second spaced ends, and an end portion joining the first ends of said rear and front portions and defining a passageway transverse of said front, rear, and end portions;

providing a plurality of lengths of adhesive;

providing at least one resiliently elastic cord;

using the lengths of adhesive to adhere the rear surfaces of the attachment members to the outer surfaces of the side portions of the peripheral wall;

positioning said one of said sides of said filter assembly along said one of the sides of said housing of said box fan assembly with the peripheries of said filter assembly and said housing generally aligned;

stretching and positioning the resiliently elastic cord through the passageways in the attachment members and between the attachment members around the side of the filter assembly opposite the box fan assembly to retain the filter assembly along the side of the housing of the box fan assembly.

* * * * *